US006406409B1

(12) United States Patent
Silver

(10) Patent No.: US 6,406,409 B1
(45) Date of Patent: Jun. 18, 2002

(54) FREE WEIGHT RACKING SYSTEM

(76) Inventor: Michael I. Silver, 70 E. 77th St., New York, NY (US) 10021

( * ) Notice: Subject to any disclaimer, the term of this patent is extended or adjusted under 35 U.S.C. 154(b) by 0 days.

(21) Appl. No.: 09/420,838

(22) Filed: Oct. 19, 1999

(51) Int. Cl.[7] ..... A63B 21/078
(52) U.S. Cl. ..... 482/104; 482/92; 482/106
(58) Field of Search ..... 482/92, 93, 98, 482/104, 105, 106, 107, 108, 109, 94

(56) References Cited

U.S. PATENT DOCUMENTS

| | | | | |
|---|---|---|---|---|
| 444,328 A | | 1/1891 | Boss | |
| 3,226,117 A | * | 12/1965 | Walklet | 482/106 |
| 4,971,305 A | | 11/1990 | Rennex | 272/118 |
| 5,137,502 A | | 8/1992 | Anastasi | 482/106 |
| 5,267,927 A | | 12/1993 | Catanzano et al. | 482/105 |
| 5,407,413 A | | 4/1995 | Kupferman | 482/106 |
| 5,511,673 A | | 4/1996 | Folk | 211/70.6 |
| 5,628,716 A | * | 5/1997 | Brice | 482/106 |
| D394,685 S | | 5/1998 | Eckmann | D21/196 |

FOREIGN PATENT DOCUMENTS

FR 1444065 5/1966

OTHER PUBLICATIONS

Body Solid Brochure (1993).*

Fitness Equipment's Online Brochure (Down/loaded Mar. 1, 1999) (http://www.fitness–equipment.com).*

Polaris Fitness Online Brochure (Downloaded Mar. 1, 1999)<http://www–plolarisfitness.com>.*

* cited by examiner

*Primary Examiner*—Jerome W. Donnelly
*Assistant Examiner*—Tam Nguyen
(74) *Attorney, Agent, or Firm*—Fitzpatrick, Cella, Harper & Scinto

(57) ABSTRACT

A combination of a set of free weight plates of at least two different sizes and a rack therefor. In the set of two or more free weight plates of different sizes, each plate has a round center bar hole and at least one racking hole. The size, shape or placement of the racking hole varies from one size weight plate to another. The rack has a set of at least two parallel, substantially horizontal posts that corresponds to each size weight plate in the set of plates. Each set of posts includes a bar hole post and at least one racking hole post that is complementary in size, shape and location to the at least one racking hole of the corresponding size weight plate.

13 Claims, 3 Drawing Sheets

FREE WEIGHT RACKING SYSTEM

BACKGROUND OF THE INVENTION

The present invention relates to a free weight racking system. Specifically, the invention involves the combination of a group of different size free weight plates and a weight rack for racking those plates, in which each different plate of the group is prevented from being racked at a position on the rack not intended for that size weight plate.

It is known in the art to use free weight plates (often called Olympic weight plates) in conjunction with different types of exercise equipment, in order to vary the amount of weight used for different exercises. The free weight plates typically come in denominations of 2.5, 5, 10, 25, 35 and 45 lbs. plates. Generally, each weight plate is disk-shaped, and includes a hole through the plate that is concentric with the circumference of the disk.

The hole in the center of each weight plate allows the plate to be mounted on exercise equipment. Free weight plates may be mounted on various types of exercise equipment, but are most commonly used in conjunction with free weight bars. The ends of the bars are cylindrical in shape and have diameters that complement the size of the bar holes in the weight plates, such that weight plates may be slid onto both ends of the bar. Typically, the bars include collars near their ends that prevent the weights from sliding toward the center of the bar, past their intended position, and for keeping the weights on either end of the bar at the same relative positions with respect to the center of the bar. Typically, equal combinations of weight plates are placed on each side of the bar to maintain balance. Thus, when a user lifts the bar at a point near the center of its length, the weights are equally supported on both ends of the bar.

The bars are generally kept parallel with the ground while the user performs various exercises, such as bicep curls or bench presses. The user adds the plates to the ends of the bars in various combinations to achieve different overall weights, depending on the type of exercise to be performed and the user's strength. Users also may vary the weight on the weight bar for different sets of repetitions of the same exercise. Accordingly, it is not uncommon for the free weight plates to be added and removed often during the course of a user's workout.

When not in use, the weight plates are normally stored on a weight rack. The racks are often simple, framed structures with a system of elevated posts on which the weight plates may be mounted (racked). The posts are typically cylindrical and extend out from the rack in a manner substantially parallel with the ground (which may include a slight slope, with the elevation at the free end of the post being slightly higher than at the point of attachment to the weight rack frame). The size of posts (i.e., diameter of the cylinder) normally complements the size of the bar holes, but the diameter may be substantially smaller than that of the bar holes. To rack the weights, a user lifts the weight plate and aligns the bar hole with the post, and then slides the weight onto the post. The posts are usually long enough to allow multiple weight plates to be stored on a single post.

Often, a number of posts are provided on two different sides of a rack, with the posts on each side being vertically aligned. The distance between the vertically arranged posts may vary depending on the weight rack. However, the distances between posts normally coincide with the size of the weight plate intended to be racked at that position (i.e, the distance between the post for racking 45 lbs. plates and the next post may be greater than the distance between other posts, to account for the size (diameter) of the 45 lbs. plate). Most racks are constructed such that the heavier weight plates are intended to be placed on the lower posts and the lighter weight plates are to be placed on the upper posts. However, because each weight plate of a set has the same size bar hole and, therefore, the weight bar posts will inherently fit each different plate, there is nothing to prevent a user from racking particular size weight plates at a number of different positions on the rack.

In practice, users often put the weight plates back in a haphazard fashion, such that the posts on a rack may from time to time carry a variety of different size weight plates. This not only leads to a disorganized appearance, it may cause problems for those trying to use the weight plates. A user may encounter a problem in which the particular size weight plate he or she needs is buried behind a number of different size plates on that post. In order to obtain the desired plate, the user must remove all of the other weight plates in front of it. Also, the user may find that the weight plates in front of the plate he wishes to use are heavier than those he typically lifts in his workout. If the weights are too heavy for the user, the user could risk injury in trying to remove the heavier weights.

The present invention is directed to a combination of free weight plates and a free weight rack that overcomes these problems associated with traditional free weight racks.

DETAILED DESCRIPTION OF INVENTION

The present invention is directed to a group of free weight plates and a weight rack therefor. In the group of free weight plates of different sizes, each weight plate includes a center bar hole and at least one racking hole. The racking hole may vary in size, shape or placement from one size weight plate to another.

The weight plates will typically be used in conjunction with a special rack system. Therefore, the invention is also directed to the combination of the group of free weight plates and the free weight rack. The combination may include a group of two or more free weight plates of different sizes, in which each plate has a center bar hole and at least one racking hole, wherein the size, shape or placement of the racking hole varies from one size weight plate to another, and a rack for storing the group of plates. The rack includes a set of at least two parallel, substantially horizontal posts corresponding to each different size weight plate in the group. Each set includes a bar hole post, and at least one racking hole post complementary in size, shape and location to the racking hole of a corresponding weight plate.

Weights

The free weight plates of the present invention may be similar in design to traditional weight plates, preferably disk-shaped, and may be provided in the same denominations (2.5, 5, 10, 25, 35 and 45 lbs. plates). The diameter of the weight plates may vary. Preferably, however, the plates may fall within the following ranges: 2.5 lbs.—about 5.5 to 7.5 inches; 5 lbs.—about 7 to 9 inches; 10 lbs.;—about 8 to 11 inches; 25 lbs.—about 10 to 12 inches; 35 lbs.—about 13 to 15 inches; and 45 lbs.—about 16 to 18 inches. The thickness of each weight plate may also vary; however, the 2.5, 5 and 10lbs. weight plates will preferably have a thickness in the range of about 1.0 to 1.5 inches. The 25, 35 and 45 lbs. weight plates will preferably have a thickness in the range of about 0.5 to 1.5 inches.

The weight plates may include a lip around the periphery of one side of the plate (i.e., along the circumference) that allows a user to grip the plate with his/her fingers when carrying and/or racking the weight plates. In alternative embodiments, the weight plates may have one or more gripping holes through which a user's fingers may be inserted, so that the user can easily grip the weight plate.

Each weight plate should include one bar hole, so that it may be mounted at the end of a free weight bar or on other types of exercise equipment.

The weight bars in most commercial gyms have cylindrical ends all having a standard size (diameter) that complements a standard size (diameter) bar hole in the weight plate. The standard bar hole has a diameter that is approximately 1.9 inches. However, the size of the bar holes in free weight plates, and hence the size of the bar ends, may vary among different weight sets. Particularly, self-contained weight systems sold for home use may not comply with the standard sizing. Accordingly, the bar holes in the free weight plates of the present invention may have diameters in the range of about 0.5 to 2 inches.

In addition to a bar hole, the free weight plates of the present invention include one or more racking holes. Preferably, a racking hole extends through a weight plate in a direction substantially parallel to the bar hole. The characteristics of the racking hole may vary among the different weights (sizes) of one group or set of weight plates (i.e., the sizes may differ among the 45, 35, 25 . . . and 2.5 lbs. weight plates). However, in preferred embodiments of the invention, the racking holes are only provided for weight plates of 10 lbs. or heavier.

The characteristics of the racking holes may differ in any number of ways, including, but not limited to the size, shape or location of the holes. Preferably, the racking holes are circular, and vary in their size and location; however, differently shaped holes, including, at least, elliptical, square and hexagonal holes, may also be used. The shape of the holes may be constant throughout a set of plates, or may vary among the different size plates of one set.

As regards the size of the racking holes, the diameter of the racking holes will preferably be in the range of about 0.5 to 1.75 inches. As regards the placement of the racking holes, that may vary among different weight plates in relation to the placement of the bar hole. Accordingly, weight plates of different sizes may have their racking holes spaced apart from the bar holes at different distances anywhere between the bar hole and the outside edge of the plate. Preferably, the distances between the racking holes and the bar holes (as measured from their centers) will be within the following ranges: 10 lbs.—about 4 to 5.5 inches; 25 lbs.—about 5 to 6 inches; 35 lbs.—about 6.5 to 7.5 inches; and 45 lbs.—about 8 to 9 inches.

Although one racking hole may achieve the benefits of the present invention, in preferred embodiments two or more racking holes are used. Most preferably, more than one racking hole is used in each weight plate. When two racking holes are used in one weight plate, it is preferable that the racking holes be located approximately 180° apart from each other on an imaginary circle that is concentric with the bar hole. When more than two racking holes are used, it is preferred that the holes be evenly spaced along an imaginary circle that is concentric with the bar hole. For instance, when three racking holes are used, the holes may be spaced 120° apart from adjacent racking holes, and when four holes are used, it is preferable that each racking hole will be located approximately 90° apart from the adjacent racking holes. By using two or more racking holes, rather than just one, the weights can be more evenly balanced when mounted on the weight bars.

Rack System

The free weight plates, when not in use, may be stored on the free weight rack of the present invention.

Although many designs for the rack are possible, the rack is preferably a simple metal frame with cylindrical metal bar posts extending therefrom. The frame may include an H-shaped base with a stand extending up from, and perpendicular to, the base. Extending so as to form a T-shape with the stand may be a support rail. In preferred embodiments, a number of support rails, one above the other, may be provided. Preferably, the support rail extends so as to be substantially parallel with the H-shaped base and the ground. The support rail may have a length in the range of about 37 to 42 inches. To support the weight plates, the cylindrical bar posts may extend out from the support rail on one or both sides thereof, so that they are substantially parallel with the ground. The bar posts may be spaced out along the horizontal length of the support rail to correspond to the weight plate diameters. Preferably, the distances may be in the range of about 12 to 14 inches. However, the distances between different posts on one rack may vary depending on the diameters of the weight plates to be mounted on those posts. If more than one support rail is used, it is preferred that the lighter weights be stored on the top support rail.

The frame may be constructed so that each bar post extends from a main support rail at a height from the ground in the range of about 24 to 36 inches. This may allow a user to rack and retrieve weights from the free weight rack without bending down to an awkward position. The diameter of the bar post may be in the range of about 0.5 to 1.75 inches, but may be consistent with the corresponding bar holes. The length of the bar posts is preferably within the range of about 6 to 12 inches, so that they may support a plurality of weight plates.

Each bar post may have associated with it one or more racking posts. The racking posts, which are preferably cylindrical, may extend out from the support rail so as to be substantially parallel with the bar posts. The racking posts associated with different bar posts should have sizes and shapes complementary to the sizes and shapes of the racking holes of the corresponding size weight plates to be mounted on those posts. In addition, the placement of the racking posts in relation to their respective bar posts should match the relative positions of the bar holes and racking holes of the corresponding size weight plates. Accordingly, each set of posts will preferably complement the racking hole(s) and bar hole of one of the different size weight plates, so that the racking post(s) and bar post at that position on the rack can be inserted through the racking hole(s) and bar hole of the complementary weight plate simultaneously.

The sizes and shapes of the racking posts may fall within the same ranges discussed above with respect to the racking hole. Of course, it is preferable that the racking post sizes be slightly smaller than the racking hole sizes, so that the posts may be easily inserted through the holes so that the weights may slide along, and be supported by, the racking posts. It is also preferable that the ends of all of the posts, both bar and racking, be beveled or frusto-conical in shape, to facilitate entry into the holes in the free weight plates.

The racking posts preferably will have lengths, as measured from the support rail to the free end, in the range of about 4 to 10 inches. Preferably, the racking posts will be shorter than the bar posts by a length in the range of about 2 to 4 inches. Thus constructed, a user may align the bar hole and the bar post and then slide the weight plate onto the bar post so that it is supported by the length of the bar post extending past the racking post. The user may then rotate the weight plate on the bar post until the racking post(s) and racking hole(s) align. The user may then slide the weight plate towards the support rail along both (or all) of the posts. In a preferred embodiment, there will be two racking posts to accommodate weight plates having two racking holes. It should be understood, however, that the racking holes may outnumber the racking posts.

Thus constructed, the racking system of the present invention may dictate where on a rack different size weight plates may be racked, thus avoiding the problems associated with traditional free weight racks.

Figure 1:
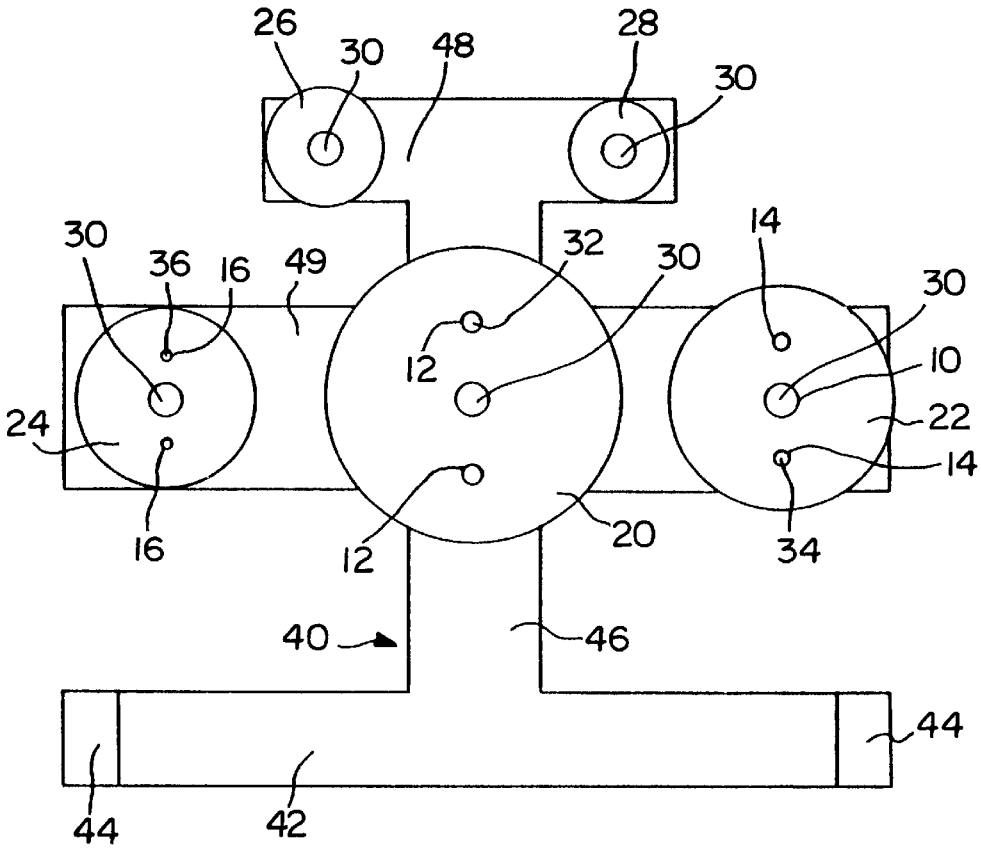
FIG. 1 is a front view of one embodiment of the free weight racking system of the present invention.
Figure 3:
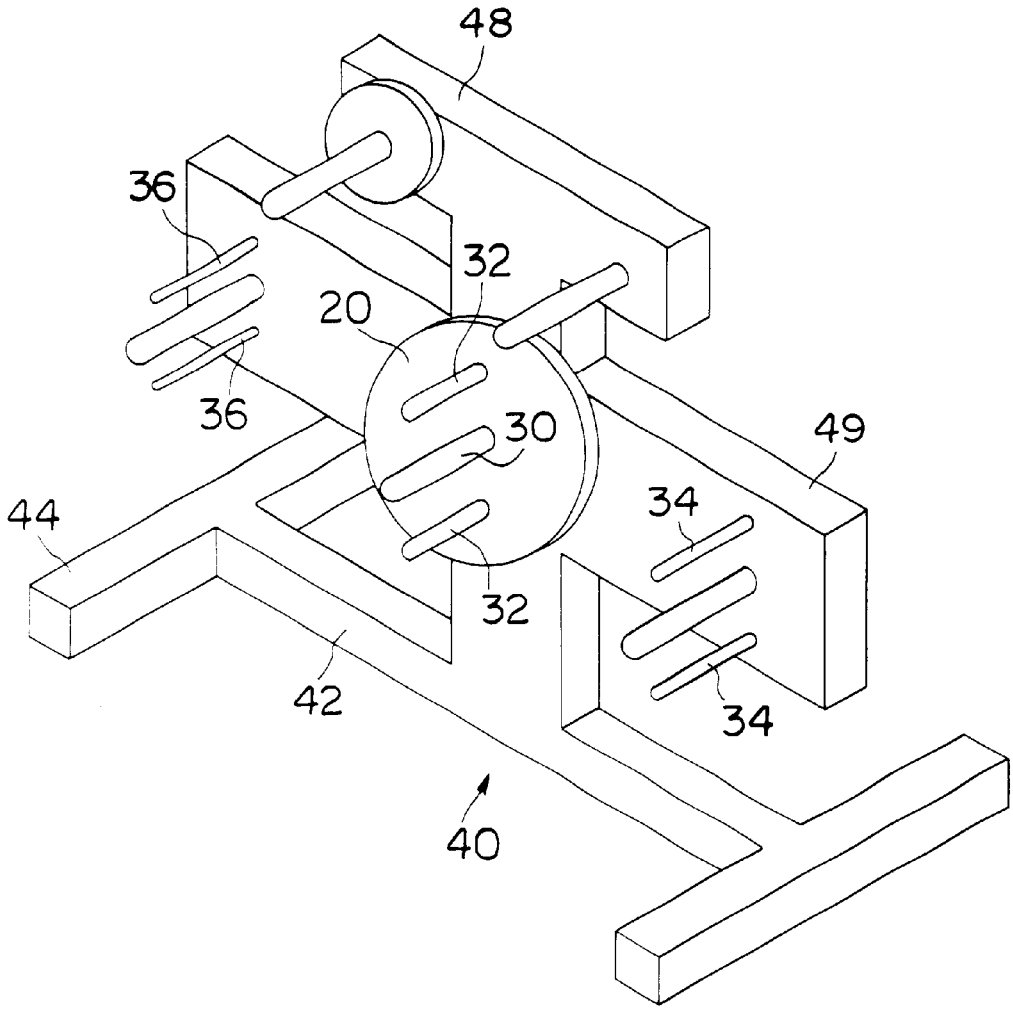
FIG. 3 is a perspective view of the free-weight racking system shown in FIG. 1.

Referring to the drawings, one embodiment of the present invention is shown in FIGS. 1 and 3. This free weight racking system includes a weight rack 40 and a group of free weight plates—namely, plate 20 (45 lbs.), plate 22 (25 lbs.), plate 24 (10 lbs.), plate 26 (5 lbs.) and plate 28 (2.5 lbs.).

Figure 4A:
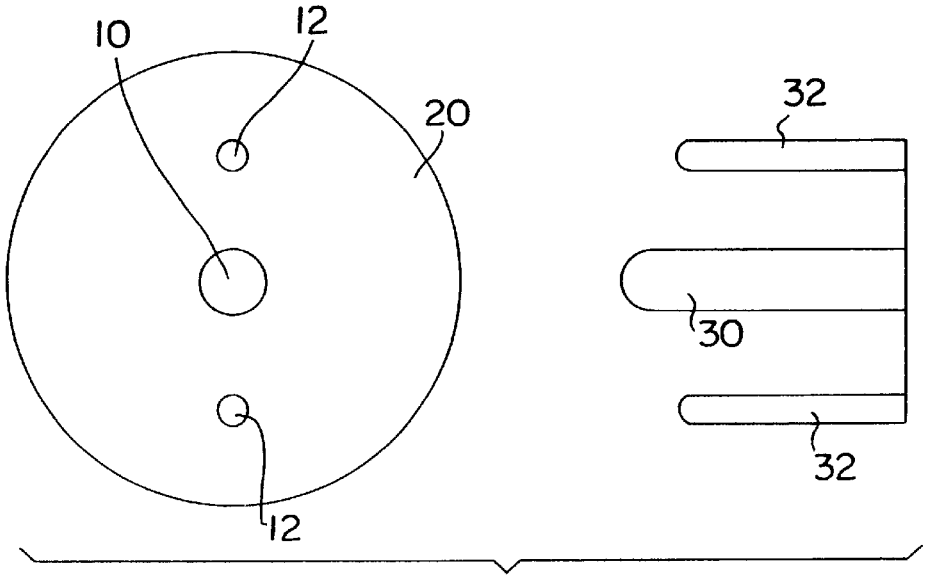
FIG. 4A is a plan view of a free weight plate, and posts for mounting that plate.

Each of the weight plates has a cylindrical bar opening 10 extending therethrough, as shown with respect to plate 20 in FIG. 4A. The bar openings 10 are concentric with the circumferences of their respective weight plates. Plate 20, plate 22 and plate 24, each include two additional openings therethrough—namely, racking holes 12, 14 and 16, respectively, which are also cylindrical in shape. The openings of each pair of racking holes 12, 14 and 16, are located 180° apart from each other on an imaginary circle concentric with the circumference of the weight plate and bar opening 10.

The diameter of racking holes 12, 14 and 16, varies among the different groups, with racking holes 12 having the largest diameter and racking holes 16 having the smallest diameter. In addition, the spacing of the pairs of racking holes 12, 14 and 16, with respect to their bar openings 10, differs among the separate size weight plates. The spacing between bar opening 10 and racking holes 12, in plate 20, is the greatest, and the spacing between bar opening 10 and racking holes 16, in plate 24, is the smallest.

All of the weight plates are designed to be racked on weight rack 40. Weight rack 40 includes an H-shaped base made up of arms 44 and center length 42 (which connects arms 44), all of which rest on the ground to provide stability to the weight rack.

Stand 46 extends up from, and substantially perpendicular to, center length 42. Stand 46 supports arms 48 and 49. Arm 49 extends out in two directions from, and perpendicular to, stand 46, and is substantially parallel with the ground and center length 42.

Figure 2:
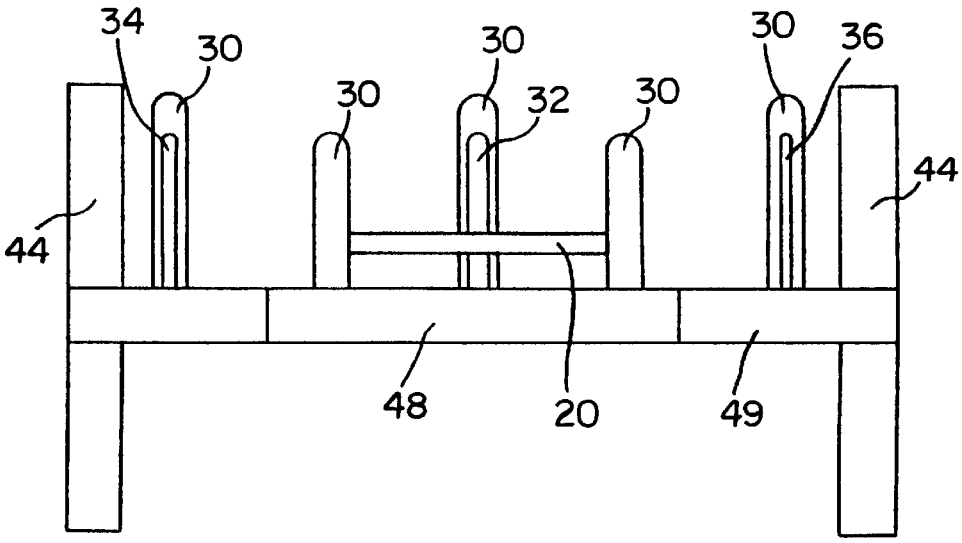
FIG. 2 is a top view of the free weight racking system shown in FIG. 1.

Arm 49 supports bar posts 30 and racking posts 32, 34 and 36, along its length, as shown in FIG. 2. Bar posts 30 and racking posts 32, 34 and 36 extend out from arm 49 such that they are substantially parallel with the ground. As shown in FIG. 2, bar posts 30 are longer than racking posts 32, 34 and 36. These posts are situated along arm 49 in such a manner that there are provided two racking posts and one bar post 30 for each type of weight plate to be mounted on arm 49. In each instance, the set of two racking posts 32, 34 or 36, are spaced apart from one another 180° on an imaginary circle concentric with the corresponding post 30. Specifically, as shown in FIG. 1, racking posts 32 are paired with a bar post 30 in the center of arm 49. The racking posts 32 and bar post 30 are vertically aligned and spaced apart from each other so as to simultaneously extend through the corresponding bar opening 10 and racking holes 12 in weight plate 20, to support weight plate 20. The racking posts 34 and 36, along with their respective bar posts 30, are similarly situated on arm 49 so as to support weight plates 22 and 24, respectively.

However, among the different groups of two racking posts and one bar post, the spacing between the racking posts and corresponding bar post 30 varies, so as to match with the type of weight plate to be mounted at that position. Accordingly, the spacing between racking posts 32 and corresponding bar post 30 is greater than the spacing between racking posts 36 and corresponding bar post 30. Because of the spacing between the bar post 30 and racking posts 32, only weight plate 20 may be mounted at that position.

In addition, the diameter of racking posts 32, 34 and 36 differs, with racking posts 32 having the largest diameter and racking posts 36 having the smallest diameter.

Arm 48 is located above arm 49 and is also mounted on stand 46. Arm 48 is substantially parallel to arm 49, center length 42, and the ground. Arm 48 also includes two additional bar posts 30, which extend out from arm 48 such that they are substantially parallel to the ground. The posts 30 on arm 48 are intended to support smaller size weight plates, such as weight plates 26 and 28. Racking post are not provided for arm 48; however, in other embodiments racking posts may be provided for these weights (in which case, weight plates 26 and 28 would include racking holes corresponding to the racking posts).

Figure 4B:
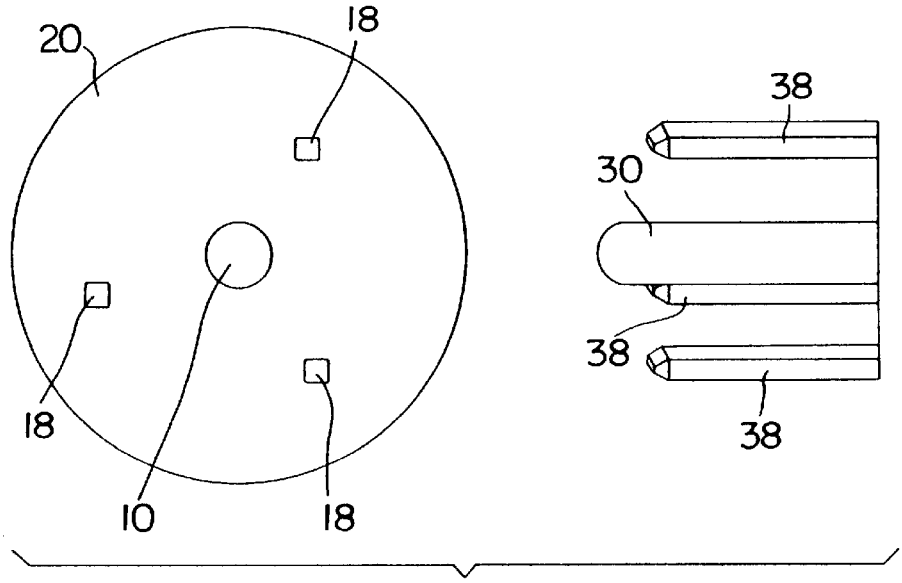
FIG. 4B is a plan view of a free weight plate of another embodiment of the free weight racking system of the present invention, and posts for mounting that weight plate.

FIG. 4B shows another embodiment of the present invention which incorporates a variation of the number of racking holes/posts, as well as a variation of the racking hole/post dimensions. As shown in FIG. 4B, weight plate 20 is provided with a bar opening 10, which is the same as described above with respect to the previous embodiment, and racking holes 18. Three racking holes 18, which are square as viewed along their length, are provided in this embodiment. Racking holes 18 are located 120° apart from each other on an imaginary circle concentric with the circumference of weight plate 20 and bar opening 10. The weight rack corresponding to this embodiment includes a bar post 30, which is the same as described above, and three racking posts 38. Racking posts 38 are square when viewed in a longitudinal direction, and are spaced apart from each other, with respect to bar post 30, so as to match the spacing of the racking holes 18. Accordingly, weight plate 20 may be mounted such that bar post 30 and racking posts 38 simultaneously extend through bar opening 10 and racking holes 18, respectively, of weight plate 20. To prevent misracking of weight plates in this embodiment, the other weight plates may include racking holes that are different in shape or number (not shown). Alternatively, misracking may be prevented by varying the spacing or size of the racking holes, as described in the previous embodiment.

What is claimed is:

1. A set of free weight plates of at least two different sizes, each weight plate of said set comprising:

a center bar hole; and at least one racking hole, wherein the size or shape of the racking hole varies from one size weight plate to another.

2. The set of free weights according to claim 1, wherein, the size of the at least one racking hole varies from one size weight plate to another.

3. The set of free weights according to claim 2, wherein, the shape of the at least one racking hole is circular as viewed in a longitudinal direction.

4. A combination of a set of free weight plates of at least two different sizes and a rack therefor, comprising:

a) a set of two or more free weight plates of different sizes, in which each plate has a round center bar hole and at least one racking hole, wherein the size, shape or placement of the racking hole varies from one size weight plate to another, and b) a rack for storing said set of plates, wherein the rack has a set of at least two parallel, substantially horizontal posts that corresponds to each size weight plate in the set of plates, each set of posts including a bar hole post and at least one racking hole post that is complementary in size, shape and location to the at least one racking hole of said corresponding size weight plate.

5. The combination according to claim 4, wherein each plate includes two racking holes located approximately 180° apart on a imaginary circle that is concentric with the bar hole, and wherein said rack includes a set of three parallel, substantially horizontal posts for each different size weight plate in the set of plates.

6. The combination according to claim 5, wherein the posts complementary to the bar holes are longer than the posts complementary to the racking holes.

7. The combination according claim 6, wherein the posts complementary to the bar holes are approximately 2 to 4 inches longer than the posts complementary to the racking holes.

8. The combination according to claim 5, wherein the shape of the at least one racking hole is circular as viewed in a longitudinal direction.

9. The combination according claim 4, wherein, in said rack, bar hole posts are mounted at a height of about 24 to 36 inches above the floor.

10. A weight rack for supporting a plurality of free weight plates of different sizes, said weight rack comprising:

a stand for storing the plurality of plates, wherein, for each of at least two different size weight plates of the plurality of plates, the stand has a set of at least two parallel, substantially horizontal posts, with each set of posts including (A) a mounting post adapted to protrude through the center bar hole of a free weight plate having such a hole and (B) a racking post adapted to protrude through a non-center hole of a free weight plate having such a hole, and wherein (i) at least two of the racking posts differ in respect of at least one of (a) the post width, (b) the post shape, in cross section, and (c) the distance separating the racking post from its corresponding mounting post, and (ii) the mounting post and racking post of each set are spaced from each other such that the mounting and racking posts are adapted to protrude through complementary holes in a corresponding weight plate when the weight plate is supported on the set of posts.

11. The weight rack of claim 10, wherein the mounting posts are longer than the racking posts.

12. The weight rack of claim 11, wherein the mounting posts are approximately 2 to 4 inches longer than the racking posts.

13. The weight rack of claim 11, wherein, in said rack, the mounting posts are mounted at a height of about 24 to 36 inches above the floor.

* * * * *